US005570834A

United States Patent [19]

Larson et al.

[11] Patent Number: 5,570,834

[45] Date of Patent: Nov. 5, 1996

[54] BOX FOR ROOF FASTENERS

[75] Inventors: Paul M. Larson, Hoffman Estates; Donal H. Egan, Fox River Grove, both of Ill.

[73] Assignee: Illinois Tool Works Inc., Glenview, Ill.

[21] Appl. No.: 596,436

[22] Filed: Feb. 2, 1996

[51] Int. Cl.[6] ..... B65D 5/465; A45F 3/00

[52] U.S. Cl. ..... 229/117.11; 224/601; 224/612; 224/615; 224/906; 229/117.25

[58] Field of Search ..... 229/117.11, 117.25; 224/601, 612, 615, 906

[56] References Cited

U.S. PATENT DOCUMENTS

| | | | |
|---|---|---|---|
| 307,431 | 11/1884 | Brown | 229/117.25 |
| 977,770 | 12/1910 | Wolf | 229/117.25 |
| 2,822,116 | 2/1958 | Smalley et al. | 229/906 |
| 3,198,300 | 8/1965 | Tuttle | 229/615 |
| 3,301,453 | 1/1967 | Stewart | 229/117.11 |
| 3,563,433 | 2/1971 | Yoshiura | 229/117.11 |
| 4,978,044 | 12/1990 | Silver | 229/615 |
| 5,165,583 | 11/1992 | Kouwenberg | 229/612 |
| 5,307,982 | 5/1994 | Swindell | 229/117.25 |

FOREIGN PATENT DOCUMENTS

| | | | |
|---|---|---|---|
| 2048217 | 12/1980 | United Kingdom | 229/117.11 |

*Primary Examiner*—Gary E. Elkins
*Attorney, Agent, or Firm*—Mark W. Croll; Thomas W. Buckman; John P. O'Brien

[57] ABSTRACT

A box doubles as a shipping carton and a dispensing container for light weight roof fasteners. The box has two end walls, each with a channel-shaped perforation therein. Top flaps connected to the end walls along respective foldlines are formed with cutouts. The cutouts in each top flap align with the perforation in the associated end wall when the top flap is folded over into facing contact with the end wall. The perforations and cutouts are offset from vertical centerlines of the end walls and top flaps. The perforations are punched out to create tabs that are pushed through the top flap cutouts, and to simultaneously produce openings in the end walls. A long strap is inserted through the cutouts and openings and looped under the box. A person can carry the box and roof fasteners in it by slinging the strap over his shoulder.

6 Claims, 3 Drawing Sheets

BOX FOR ROOF FASTENERS

BACKGROUND OF THE INVENTION

1. Field of the Invention

This invention pertains to parts handling, and more particularly to apparatus for transporting and dispensing light weight fasteners, especially fasteners for cementitious cement roofing.

2. Description of the Prior Art

In the construction of some built-up roofs, a light weight cementitious deck is covered by a layer of flexible material. The flexible material is usually in the form of a thin base sheet of plastic or tar paper. To keep the base sheet in place, suitable fasteners are driven through it and into the cementitious deck. A typical roofing fastener is one known as Buildex Lite Weight Concrete Fastener sold by Illinois Tool Works, Inc. of Glenview. Ill.

Traditionally, the light weight fasteners, including fasteners for cementitious cement roofing, have been shipped from the manufacturer to a construction site in paperboard cartons. At the job site, a workman opened the cartons and placed about 30 to 40 fasteners in a pouch. The workman carried the pouch and fasteners to the particular locations on the roof where the fasteners were to be installed. When his pouch was empty, the workman walked back to the carton for more fasteners.

A considerable amount of time was wasted walking back and forth between the carton of fasteners and the location where the fasteners were to be installed. In addition, the repeated bending of the workmen when transferring fasteners from the carton to their pouches was undesirable.

SUMMARY OF THE INVENTION

In accordance with the present invention, a box for roof fasteners is provided that assists construction workers to easily and efficiently install fasteners in a cementitious roof. This is accomplished by constructing the box to function as both a transportation carton and an on-site dispensing container.

The box is made by folding a blank to have a bottom wall, two side walls, and two end walls. A first pair of top flaps connect to the side walls, and a second pair of top flaps connect to the end walls. The first and second pairs of top flaps can be folded over the bottom wall to form a top of the box.

Each end wall is formed with a channel-shaped perforation. The perforations are offset from the vertical centerlines of the respective end walls. The second pair of top flaps are formed with cutouts. The cutouts in the top flaps align with the perforations in the end walls when the flaps are folded over into facing contact with the end walls.

The box of the invention is filled with roof fasteners at their manufacturing plant. The box is closed by folding the top flaps with the first pair of top flaps overlying the second pair. The box thus serves as a transportation carton for safely shipping the roof fasteners.

When the fasteners are ready to be used on a roofing job, the first pair of the box top flaps are opened and folded against their associated side walls. The second pair of top flaps are opened. The end wall perforations are punched out to create two tabs that can bend along unperforated lines extending between the free ends of the channel-shaped perforations. Punching out the perforations to create the tabs simultaneously produces openings in the end walls at the locations of the perforations. The second top flaps are folded into facing contact with the associated box end walls, and the tabs are pushed through the aligned cutouts in them. The tabs are then bent back against the associated second flaps.

A long strap is inserted through the aligned openings in the box end walls and cutouts in the associated second top flaps. The strap is looped under the box bottom wall, where it can be buckled. The strap is placed over a worker's shoulder. The light weight of the carton and fasteners, and the offset location of the openings in the box end walls, enable the worker to comfortably carry a full supply of fasteners with him as he installs them on a roof.

The method and apparatus of the invention, using a combination transportation carton and on-site dispensing container, thus enables a worker to carry a large number of roof fasteners with him on a roof site. The inefficiencies and physical stress of periodically walking to and bending at a central supply to transfer fasteners from one container to another are eliminated.

Other advantages, benefits, and features of the present invention will become apparent to those skilled in the art upon reading the detailed description of the invention.

BRIEF DESCRIPTION OF THE DRAWINGS

FIG. 6 is a reverse perspective view of the box of the invention in a partially unfolded condition.

DETAILED DESCRIPTION OF THE PREFERRED EMBODIMENT

Figure 1:
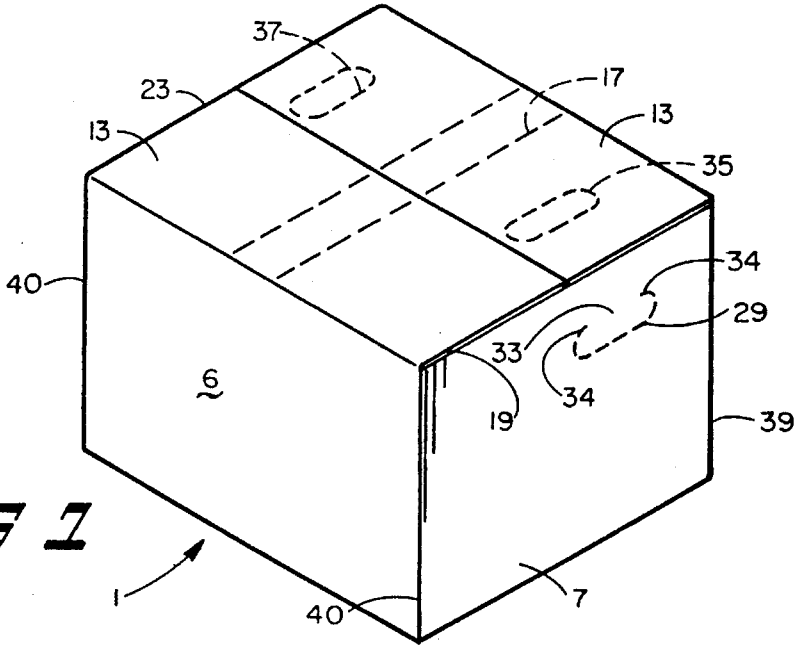
FIG. 1 is a perspective view of the box of the invention showing it in the folded condition.
Figure 4:
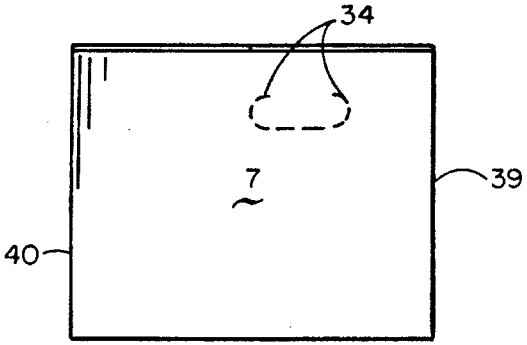
FIG. 4 is an end view of FIG. 1.
Figure 2:
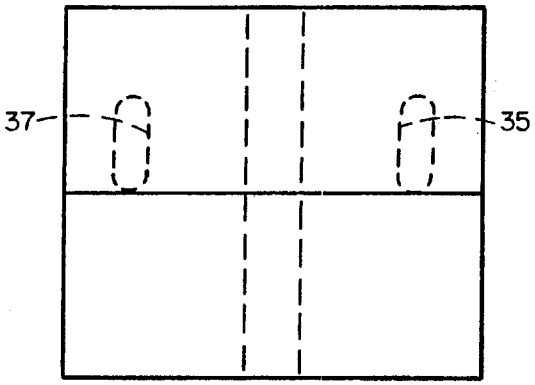
FIG. 2 is a top view of FIG. 1.
Figure 3:
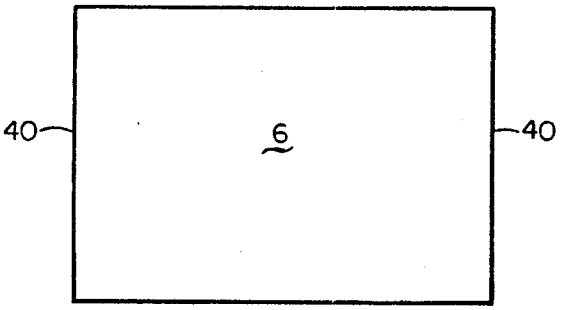
FIG. 3 is a side view of FIG. 1.
Figure 5:
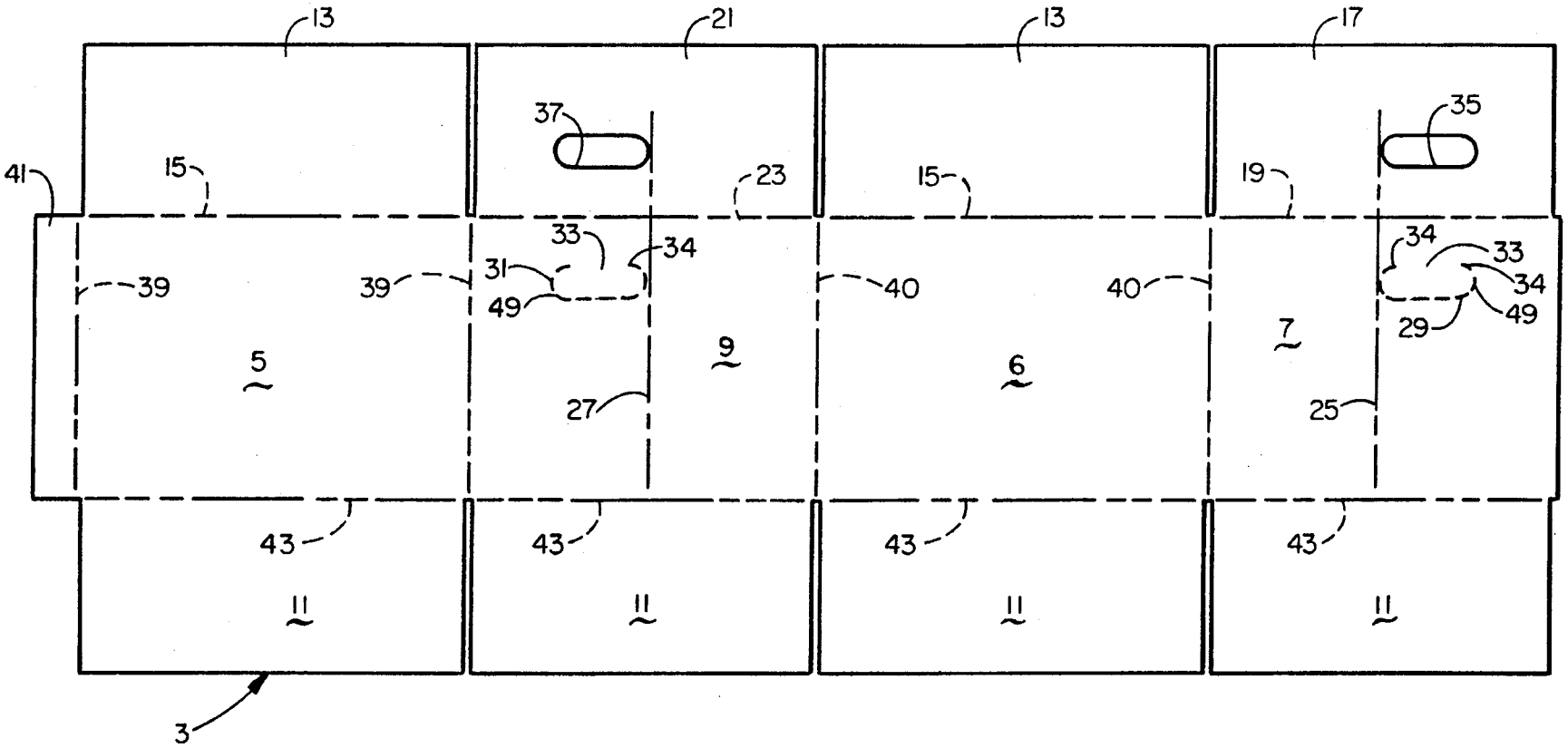
FIG. 5 is a top view of a blank of material from which the box of the invention is constructed.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring to FIGS. 1–5, a box 1 is illustrated that includes the present invention. The box 1 is particularly useful for holding a quantity of light weight roof fasteners used in the construction of built-up roofs having cementitious decks. An example of such fasteners may be seen in co-pending U.S. patent application Ser. No. 08/321,553.

The box 1 is made from a blank 3, which preferably is conventional paperboard. The blank 3 has two side walls 5 and 6, two end walls 7 and 9, and four bottom panels 11. Top flaps 13 connect to associated side walls 5 and 6 by respective foldlines 15. A top flap 17 is connected to the end wall 7 along foldline 19. Another top flap 21 is connected to the end wall 9 by a foldline 23. The end wall 7 and top flap 17 define a common vertical centerline 25. The end wall 9 and top flap 21 define a similar common vertical centerline 27.

In accordance with the present invention, the end walls 7 and 9 of the blank 3 are formed with generally channel-shaped perforations 29 and 31, respectively. In the illustrated construction, the perforations 29 and 31 are partially obround in shape. Each perforation has two free ends 34. There is a straight line portion 33 between the free ends 34 of each perforation that is not perforated. The perforations are located closer to the respective top flaps 17 and 21 then to the bottom panels 11. The perforations are offset from the vertical centerlines 25 and 27 of the end walls 7 and 9, respectively. Specifically, the perforations are located on the opposite side of the respective centerlines as the side wall 6.

The top flap 17 is formed with a cutout 35, and the top flap 21 is formed with a similar cutout 37. The cutouts 35 and 37 are located equidistantly from the foldlines 13 and 23, respectively, as the perforations 29 and 31. The cutouts are also located at the same locations relative to the centerlines 25 and 27 as the perforations. The cutouts are the same size and shape as the outlines of the perforations.

The box 1 is assembled by folding the blank 3 along foldlines 39 and 40 between the side walls 5 and 6 and the end walls 7 and 9. A blank strip 41 is placed into facing contact with the end wall 7 and adhered thereto with adhesive in known manner. The bottom panels 11 are folded along their respective foldlines 43 to make a bottom wall for the box. The bottom panels can be adhesively joined to each other.

The resulting box 1 is filled with a quantity of light weight roof fasteners. The top flaps 17 and 21 are closed first, with the flaps 13 overlying them. The top flaps are sealed, thus producing a transportation carton as shown in FIGS. 1–4. Despite the perforations 29 and 31, the end walls 7 and 9 are sufficiently strong to retain the roof fasteners inside the box for shipment from the fastener manufacturer to a roofing job site.

Figure 7:
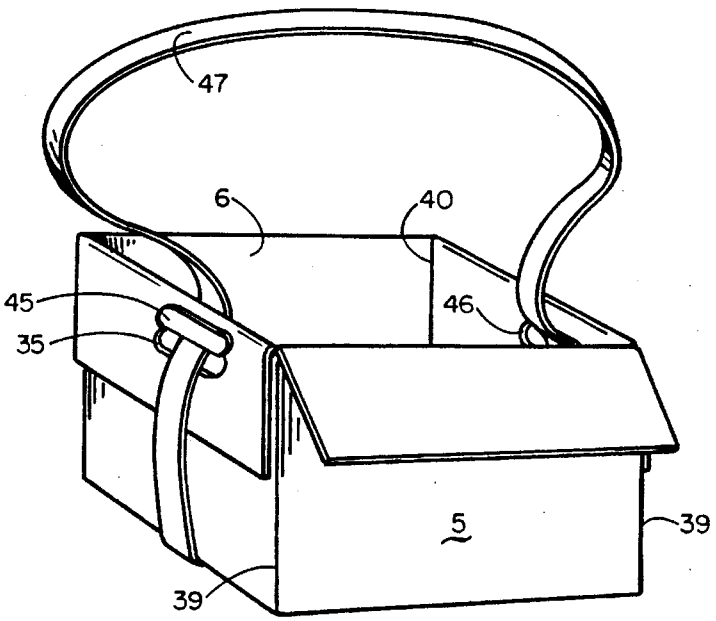
FIG. 7 is a view similar to FIG. 6, but showing the box in the fully unfolded condition and with the strap assembled thereto.

At the job site, the top flaps 13, 17, and 21 are opened, FIG. 6. The perforations 29 and 31 are punched out toward the outside of the box 1 to create obround tabs 45. The tabs 45 are bent along the unperforated line portions 33. Punching out the perforations simultaneously produces openings 46 in the end walls 7 and 9. The top flaps 17 and 21 are folded back along their respective foldlines 19 and 23 to be in facing contact with the end walls 7 and 9, respectively. The cutouts 35 and 37 are aligned with the openings 46 in the associated end walls. The tabs 45 are pushed through the corresponding cutouts in the top flaps, and the tabs are bent back into overlying facing contact with the flaps, FIG. 7.

A long flexible strap 47 is fed through the cutouts 35, 37 and the openings 46, preferably from the inside to the outside of the box 1. The strap is buckled under the box bottom panels 11.

Figure 8:
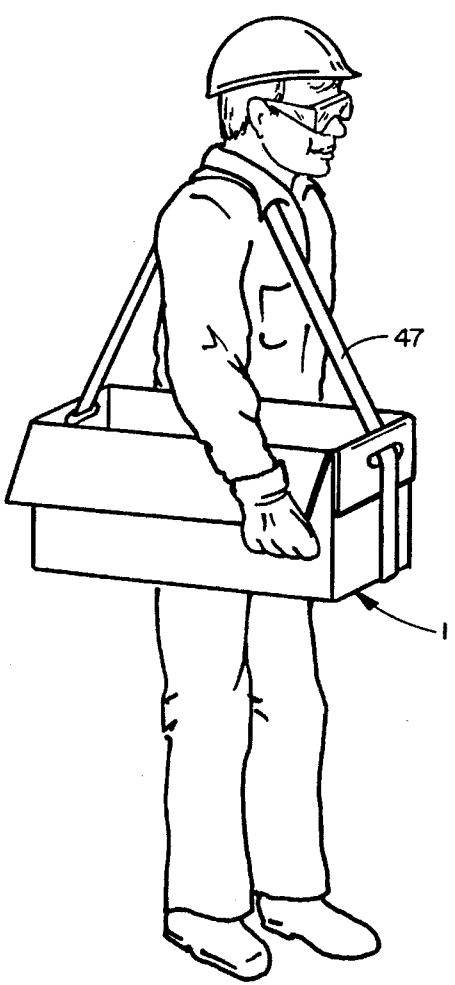
FIG. 8 is a view showing a worker carrying the box of the invention.
Figure 9:
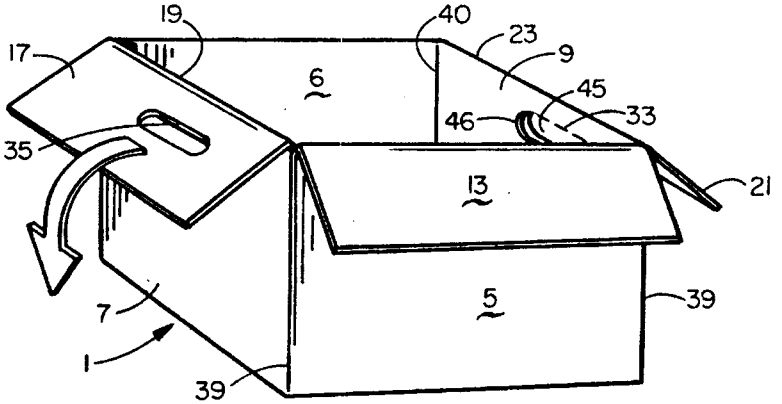

FIG. 8 shows the box 1 of the invention in use as a dispensing container for the roof fasteners. A worker slings the strap 47 over his shoulder. Both hands are then free to remove fasteners from the box and install them in the roof deck. A large number of fasteners can thus be easily and conveniently carried in the box on a job site. The offset locations of the top flap cutouts 35, 37 and end wall openings 46 add to the ease and comfort of carrying the box.

An example of a box 1 that works very well is as follows. The box is approximately 16 inches long, 14 inches wide, and 11.50 inches high. The unperforated line portions 33 of the perforations 29 and 31 are located approximately two inches from the foldlines 19 and 23, respectively. The perforation ends 49 closest to the foldlines 39 are located approximately 3.125 inches from those foldlines. A box of the foregoing size holds approximately 500 roof fasteners with a total weight of only about 20 pounds. Consequently, a worker can carry the box and fasteners with him around a roof without problem.

In summary, the results and advantages of light weight roof fasteners can now be more fully realized. The box 1 of the invention provides both a shipping carton and a dispensing container for the roof fasteners. This desirable result comes from using the combined functions of the perforations 29 and 31. When the blank 3 is initially manufactured and folded to make the box, the perforations keep the fasteners inside the box for transportation. At a job site, the perforations are punched out to create the tabs 45. The tabs 45 cooperate with the cutouts 35 and 37 in the top flaps 17 and 19, respectively, to hold the top flaps against the box end walls 7 and 9. The strap 47 enables a worker to carry the box and fasteners over his shoulder. It will also be recognized that in addition to the superior performance of the box of the invention, its cost is no more than that of traditional paperboard cartons.

Thus, it is apparent that there has been provided, in accordance with the invention, a box for roof fasteners that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A box for transporting and dispensing roof fasteners comprising:

a. two opposed side walls;

b. two opposed end walls joined to the side walls, each end wall having a generally channel-shaped perforation formed therein;

c. a bottom wall joined to the side and end walls;

d. two first top flaps connected to associated of the side walls along first foldlines;

e. two second top flaps connected to associated of the end walls along second foldlines, each second top flap having a cutout therein that is aligned with the perforation of the associated end wall when the top flap is folded along the associated foldline back against the end wall, each of the perforations being punchable to create a tab that cooperates with the cutout in the associated top flap to hold the top flap against the associated box end wall and to simultaneously produce an opening in the end wall that is aligned with the cutout in the top flap; and f. strap means passing through the end wall openings and top flap cutouts and looping under the box bottom wall for enabling a person to sling the strap means over his shoulder and thereby carry the box and roof fasteners placed therein around a job site.

2. The box of claim 1 wherein the perforations in the end walls are partially obround in shape, and wherein the cutouts in the second top flaps are obround in shape.

3. The box of claim 1 wherein:

a. each end wall and associated second flaps defines a vertical centerline;

b. the perforations of the end walls and the cutouts in the associated second flaps are located offset to the associated vertical centerlines; and c. the perforations are located closer to the top flaps than to the box bottom wall.

4. A blank of material useful for folding into a box having two side walls, two end walls, four bottom panels connected to the side and end walls, first top flaps connected to the side walls along respective first foldlines, and second top flaps connected to the end walls along respective second foldlines, each end wall and associated second top flap defining a vertical centerline, each end wall being formed with a perforation having a predetermined size and shape and an end located at a first predetermined distance from the associated second foldline and at a second predetermined distance from the associated vertical centerline, each second top flap being formed with a cutout of the same size and shape as one of the end wall perforations and an end located at the first predetermined distance from the second foldline and at the second predetermined distance from the vertical centerline.

5. The blank of claim 4 wherein the respective ends of the perforations in the end walls and the cutouts in the second top flaps are offset from the associated vertical centerlines.

6. The blank of claim 4 wherein:

a. the perforation in each end wall is partially obround in shape; and b. the cutout in each second top flap is obround in shape.

* * * * *